US005433255A

United States Patent [19]

Wiedel

[11] Patent Number: 5,433,255

[45] Date of Patent: Jul. 18, 1995

[54] WIRE KNOTTER HEAD YOKE COVER WITH REPLACEMENT INSERTS

[75] Inventor: John Wiedel, Chicago, Ill.

[73] Assignee: L&P Property Management Company, Chicago, Ill.

[21] Appl. No.: 165,324

[22] Filed: Dec. 13, 1993

[51] Int. Cl.[6] ..... B21F 15/04

[52] U.S. Cl. ..... 140/115; 140/93.6

[58] Field of Search ..... 140/36, 93 R, 93.6, 140/105, 115

[56] References Cited

U.S. PATENT DOCUMENTS

| | | | |
|---|---|---|---|
| 413,666 | 10/1889 | Hill | 140/36 |
| 1,669,047 | 5/1928 | Gerrard et al. | 140/93.6 |
| 3,338,273 | 8/1967 | Kalning | 140/101 |

*Primary Examiner*—Lowell A. Larson
*Attorney, Agent, or Firm*—Wood, Herron & Evans

[57] ABSTRACT

A yoke cover assembly for attachment to a wire tieing machine includes a body member which has recesses therein and wire engaging inserts removably attached thereto. The inserts are secured to the body member by roll pins. The inserts are seated in the recesses and engage wires when an end portion of the wires is being twisted by the wire tieing machine. The inserts are replaceable with other like inserts.

6 Claims, 1 Drawing Sheet

WIRE KNOTTER HEAD YOKE COVER WITH REPLACEMENT INSERTS

BACKGROUND OF THE INVENTION

This invention is generally directed to a yoke cover for a wire tieing machine. More particularly, this invention relates to a yoke cover that includes a pair of wire engaging inserts against which the wires that are being tied are supported during tieing.

Prior art wire tieing machines are provided with a pair of hardened steel wear plates which are brazed onto a yoke cover. The wear plates engage and support the wires when the wires are being tied by the machine. Due to this engagement, the wear plates become worn and eventually, the wear plates must be replaced. Since the wear plates are brazed onto the yoke cover, the entire yoke cover must be discarded and replaced. This need for replacement of the entire yoke cover increases the cost of the wire tieing machine. Furthermore, since the wear plates are brazed onto the yoke cover, the hardness of the steel may be reduced.

The present invention is intended to overcome or minimize all of these problems, as well as to present several other improvements.

OBJECTS AND SUMMARY OF THE INVENTION

A general object of the present invention is to provide a wire tieing machine and a yoke cover that includes inserts that may be replaced by other like inserts when worn.

Another object of the present invention is to provide inserts that increase the life of the yoke cover.

It is another object of the present invention to provide steel inserts that are attached to a yoke cover such that steel hardness retention is ensured.

It is a further object of the present invention to provide steel inserts which may be easily replaced in the field.

It is a specific object of the present invention that the cost of replacing parts is reduced over prior wire tieing machines.

Briefly, and in accordance with the foregoing, the present invention discloses a yoke cover for a wire tieing machine that twists or ties together end portions of wires. The wire tieing machine generally includes side plates, a spacer member for connecting the side plates to each other, a twister pinion rotatably connected to the spacer member, roller arms which are rotatably connected to the side plates and yokes which are attached to the side plates. The twister pinion twists the end portions of the wires. The yokes guide the wires into the twister pinion.

The yoke cover is mounted for pivotal movement on the roller arms. The yoke cover includes a body member with recesses therein, wire guides and a guide finger attached to the body member and wire engaging, generally T-shaped inserts. The inserts are removably secured by roll pins to the body member and are seated within the recesses. The inserts engage the wires when end portions of the wires are being twisted or tied together by the wire tieing machine. The inserts are replaceable with other like inserts.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
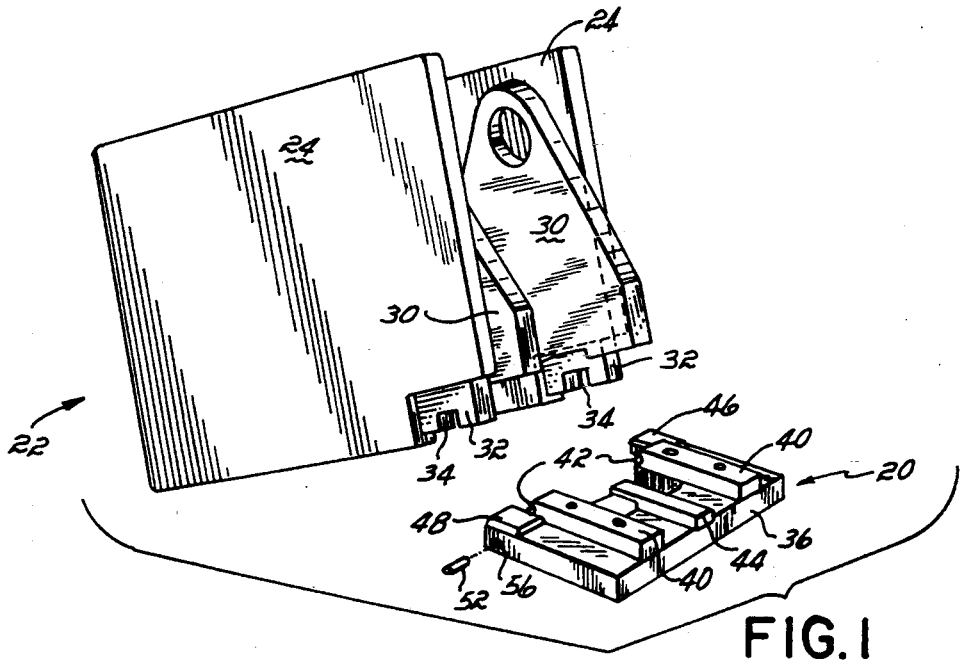
FIG. 1 is a simplified perspective view of a wire tieing machine and a yoke cover according to the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

A yoke cover assembly or unit 20 incorporating features of the present invention is shown in the drawings. This yoke cover assembly 20 may be used in various wire tieing machines 22 of known construction, so that such machines 22 need not be described in detail herein. FIG. 1 provides a simplified illustration of one such machine 22, in which the assembly 20 may be mounted.

In general, the machine 22 is comprised of a pair of side plates 24 with a spacer-knotter 26 connecting the side plates 24 together and spacing the side plates 24 apart. A twister pinion 28 for twisting or tieing together two end portions of a pair of wires (not shown) is rotatably mounted on the spacer 26 by suitable bushing means. The twister pinion 28 may be made in various configurations and is of well known construction, so that the twister pinion 28 need not be described in detail herein. A pneumatic or hydraulic cylinder; electric or hydraulic motor (not shown), which is attached to the side plates 24 by suitable means, drives the twister pinion 28. A pair of roller arms 30 are rotatably attached to the interior of the side plates 24 by known means, such as bearings and spacers.

A yoke 32 is mounted on the bottom end of each of the side plates 24 by suitable means, such as screws. Each yoke 32 is comprised of a rigid body member with a recess portion 34 in the center thereof. The recess 34 is open to the bottom of the body member.

As shown in the drawings, the yoke cover assembly 20 is comprised of a rigid, generally rectangular body member 36 having top and bottom surfaces and recesses defined therein. One recess 38 is generally U-shaped and provides clearance for the twister pinion 28 when the yoke cover assembly 20 is attached to the wire tieing machine 22.

A pair of rectangular wire guides 40 are mounted on the top surface of the body member 36 by suitable means as described hereinbelow. Each wire guide 40 includes a wire receiving slot 42 at one end thereof. A guide finger 44 is also attached to the top surface of the body member 36 by suitable means. As shown, the guide finger 44 is seated in a shallow recess.

A pair of inserts or wear plates 46, 48 are secured to the body member 36 by fasteners, such as roll pins 50, 52. The inserts 46, 48 are made of suitable materials that can withstand a significant amount of frictional wear, such as hardened steel. The inserts 46, 48 engage and support the wires when the end portions of the wires are being twisted or tied together by the wire tieing machine 22. The inserts 46, 48 are seated within complementarily shaped recesses in the body member 36.

Figure 2:
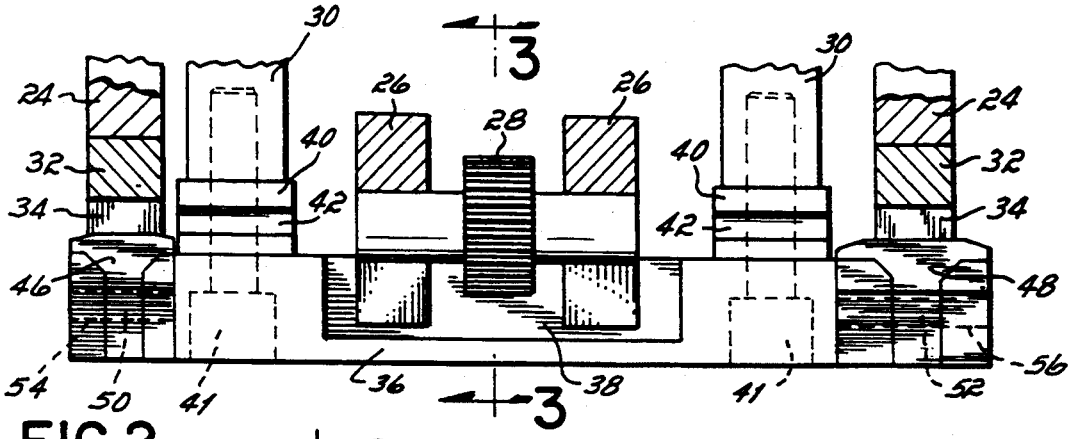
FIG. 2 is a partial sectional view of the wire tieing machine and yoke cover along line 2—2 in FIG. 3.
Figure 3:
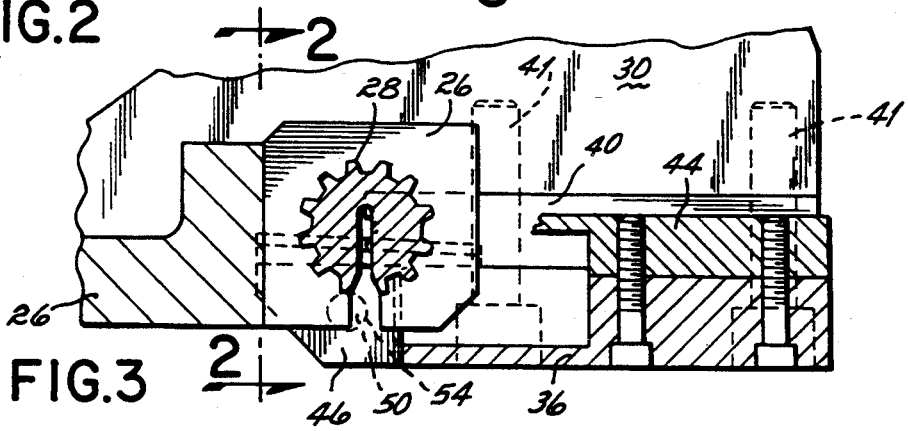
FIG. 3 is a partial sectional view of the wire tieing machine and yoke cover along line 3—3 in FIG. 2.
Figure 4:
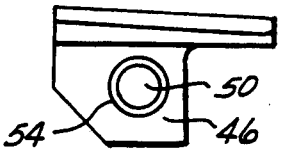
FIG. 4 is a side elevational view of one of the inserts.
Figure 5:
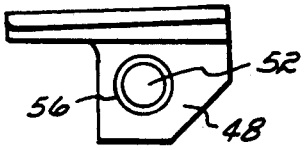
FIG. 5 is a side elevational view of the other one of the inserts.

As shown in FIG. 2, the end view of the wire engaging inserts 46, 48 shows that an end of each insert 46, 48 is generally T-shaped with a shank portion and a head portion which includes two arms cantilevered from a top portion thereof. As shown in FIG. 2, the inserts 46, 48 may be of different sizes. As shown in FIGS. 3–5, the side view of each insert 46, 48 is generally L-shaped with a shank portion and a head portion which includes an arm cantilevered from a top portion thereof. Each insert 46, 48 includes a through aperture 54, 56 in the shank portion so that the roll pin 50, 52 may be inserted therethrough to securely hold the insert 46, 48 onto the yoke cover body member 36.

The roll pins 50, 52 used in the present invention are of a well known construction. The roll pins 50, 52 may be made of split tubes of steel which expand within the through apertures 54, 56 to securely hold the inserts 46, 48 in place.

The wire engaging inserts 46, 48 may be easily replaced when the inserts 46, 48 become worn due to the frictional wear created by the engagement of the wires during twisting or tieing. To remove the inserts 46, 48, the roll pins 50, 52 are pushed through aperture 54, 56 and removed, and the inserts 46, 48 are pushed out of the yoke cover body member 36. The worn inserts are replaced with other inserts of like constructions.

The novel feature of utilizing replaceable wire engaging inserts 46, 48 presents several significant advantages. The entire yoke cover assembly 20 does not need to be replaced as in prior art yoke covers and therefore, the cost of replacing parts is reduced. The body member 36 of the yoke cover assembly 20 may be reused. Moreover, the inserts 46, 48 are easily replaced in the field. Furthermore, since the inserts 46, 48 are secured to the yoke cover body member 36 by roll pins 50, 52 instead of by brazing as in prior art yoke covers, steel hardness retention is ensured. This increases the life of the insert and decreases part breakage.

As best shown in FIG. 2, the yoke cover assembly 20 is Secured to the bottom end of the roller arms 30 by suitable means, such as screws 41, which extend through the body member 36 and the wire guides 40 and into the roller arms 30. When the yoke cover assembly 20 is located in a wire receiving configuration, the yoke cover assembly 20 is rotated outwardly and upwardly by rotating the rollers arms 30 relative to the side plates 24. Once the yoke cover assembly 20 is outwardly and upwardly rotated, the ends of the wires to be twisted or tied together are fed into the slot of the twister pinion 28.

Thereafter, the yoke cover assembly 20 is positioned in a wire twisting or tieing configuration by rotating the yoke cover assembly 20 and roller arms 30 inwardly and downwardly until the wire engaging inserts 46, 48 are in a position generally beneath the wires to be twisted or tied. The slot 42 in the end of each wire guide 40 receives a wire therein. Since the recess 34 in each yoke 32 is open towards the bottom, a passage for guiding the wires therethrough is created between each yoke 32 and each inserts 46, 48. When the end portions of the wires are being twisted or tied together, the inserts 46, 48 engage and support the wires. The end portions of the wire may be twisted or tied by the wire tieing machine 22 by known methods.

While a preferred embodiment of the present invention is shown and described, it is envisioned that those skilled in the art may devise various modifications of the present invention without departing from the spirit and scope of the appended claims. The invention is not intended to be limited by the foregoing disclosure.

The invention claimed is:

1. A wire tieing machine for twisting or tieing together end portions of wires comprising:

side plates;

a spacer member for connecting said side plates to each other and for spacing said side plates apart a predetermined distance;

a twister pinion means for twisting or tieing together end portions of a wire, said twister pinion means being rotatably connected to said spacer member;

roller arm members rotatably connected to an interior portion of said plates;

yoke members attached to said side plates for guiding end portions of wires into said twister pinion means; and a yoke cover mounted for pivotal movement on said roller arm members, said yoke cover comprising a body member having vertical slots therein and wear plate inserts removably attached to said body member, said inserts each being generally T-shaped in cross-section with a top horizontal cross bar having a too surface and an underside, said cross bar having a vertical leg extending downwardly from a centerline of said underside, said vertical leg being received in said vertical slot of said body member, said top surface engaging the wires when the end portions of the wires are being twisted by the pinion means, said inserts being replaceable with other like inserts.

2. A wire tieing machine as defined in claim 1, wherein roll pins removably secure the inserts to the body member, each of said roll pins extending in an aligned aperture in said vertical leg and said body member when each of said inserts is attached to said yoke cover.

3. A yoke cover for attachment to a wire tieing machine comprising:

a body member having a vertical recess therein; and a generally T-shaped cross-section wire engaging insert having a horizontal head portion and a vertical shank portion, said vertical shank portion extending downwardly from an underside surface of said head portion, said shank portion being seated in said vertical recess of said body member, said head portion being adapted to engage wires when end portions of the wires are being twisted by the wire tieing machine, and a removable fastener securing said vertical shank portion within said body member recess whereby said insert is easily replaceable with other like inserts.

4. A yoke cover as defined in claim 3, wherein said fastener is a roll pin extending in an aligned aperture in said vertical shank portion and the body member.

5. A yoke cover as defined in claim 3, further including wire guide members and a guide finger member, said wire guide members and said guide finger member being attached to said body member.

6. A yoke cover as defined in claim 3, wherein said body member has at least two inserts attached thereto.

* * * * *